US005361598A

United States Patent [19]

Roseen

[11] Patent Number: 5,361,598

[45] Date of Patent: Nov. 8, 1994

[54] REFRIGERATOR OR FREEZER WALLS

[75] Inventor: Rutger A. Roseen, Lidingö , Sweden

[73] Assignee: Electrolux Research & Innovation Aktiebolag, Sweden

[21] Appl. No.: 115,895

[22] Filed: Aug. 31, 1993

[30] Foreign Application Priority Data

Sep. 10, 1992 [SE] Sweden ..... 9202607-9

[51] Int. Cl.[5] ..... F25B 1/00

[52] U.S. Cl. ..... 62/229; 165/96

[58] Field of Search ..... 165/96 HV; 62/229

[56] References Cited

U.S. PATENT DOCUMENTS

| | | | |
|---|---|---|---|
| 3,270,802 | 9/1966 | Lindberg | 165/96 HV |
| 3,968,831 | 7/1976 | Xenophou | 165/96 HV |
| 3,990,201 | 11/1976 | Falbel | 165/96 HV |
| 4,668,555 | 5/1987 | Uekado et al. | 428/69 |

FOREIGN PATENT DOCUMENTS

| | | |
|---|---|---|
| 1126212 | 11/1956 | France . |
| 665319 | 9/1938 | Germany . |
| 389535 | 3/1933 | United Kingdom . |
| 430123 | 6/1935 | United Kingdom . |

*Primary Examiner*—William E. Tapolcai

*Attorney, Agent, or Firm*—Pearne, Gordon, McCoy & Granger

[57] ABSTRACT

This invention relates to an electric refrigerator or freezer. The cabinet comprises one or several hermetically sealed heat insulated spaces (14) which are wall or door panels of the cabinet. The space or spaces communicate with a vacuum creating device (18) via an evacuation conduit (17). A vacuum creating device is a permanently installed unit in the cabinet which is arranged to be activated when or after the cabinet has been installed by the user of the cabinet. After a long period of running the vacuum device creates a suitable underatmospheric pressure in the space or spaces (14).

9 Claims, 1 Drawing Sheet

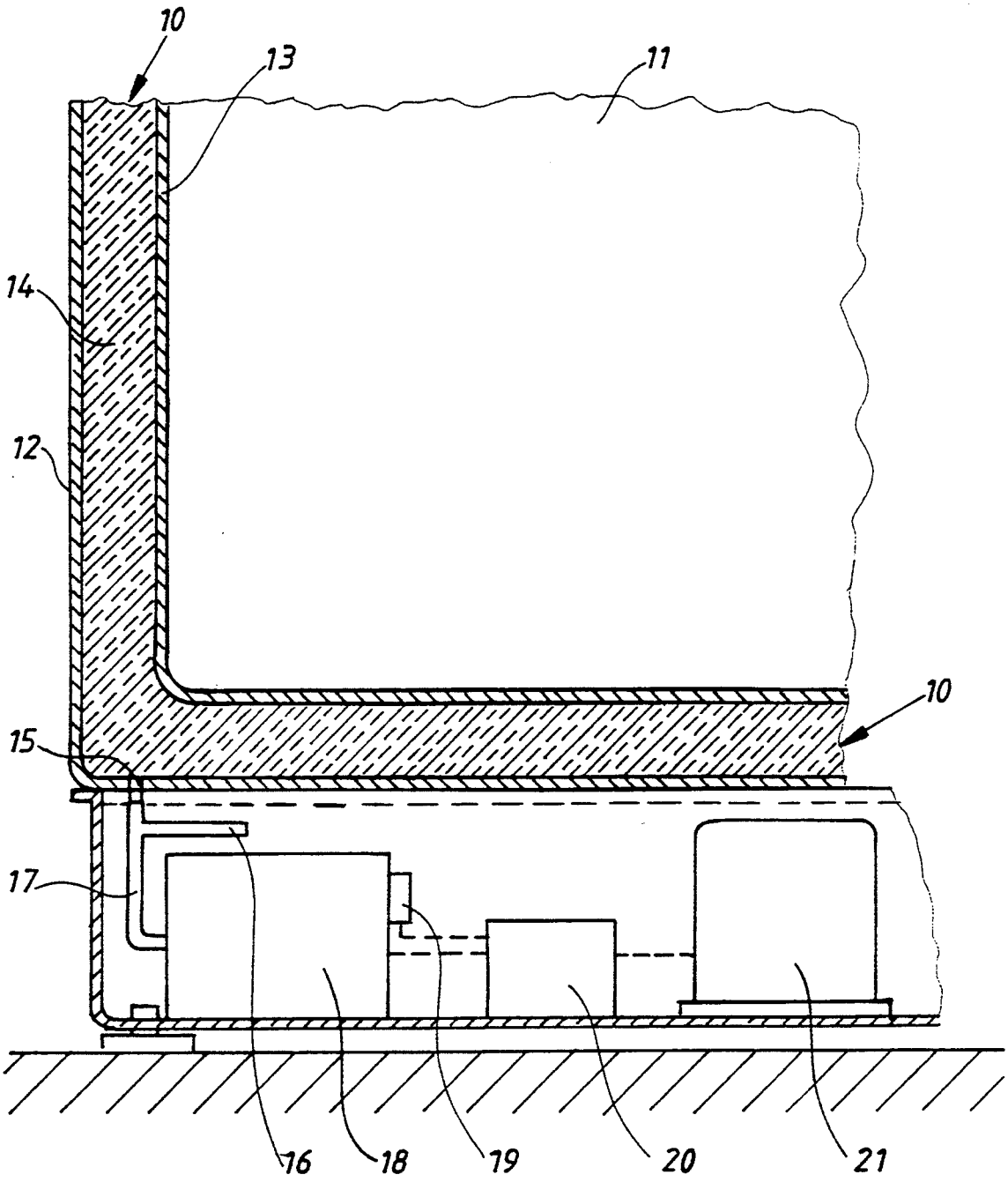
10
13
11
14
12
10
15
17
16
18
19
20
21

REFRIGERATOR OR FREEZER WALLS

BACKGROUND OF THE INVENTION

1. Field of the Invention

This invention relates generally to an electric refrigerator or freezer and specifically to insulating walls therefor.

2. Description of the Related Art

It is previously known to use different types of insulation material for refrigerator and freezer cabinets in order to achieve as good insulation characteristics as possible for walls and doors of the cabinet. Usually foamed plastic materials having open as well as closed cell structures are used between inner and outer metal plates and/or plastic shells in the walls, but it has also been suggested to use different types of insulating powder materials.

In order to reduce the power consumption of the cabinets, it has also been suggested to use so called "vacuum panels" in the walls and the doors. See for instance EP 188806. When manufacturing these panels a powder or cellular material is surrounded by a diffusion-tight layer which is placed between the outer and the inner shell of the wall, after which the space containing the powder is evacuated and sealed. By means of this method it is, however, in industrial processes, difficult to reach sufficiently low pressures to maximize the insulation characteristics, since the evacuation process is very time consuming and is not well suited for mass fabrication. It should in this connection be mentioned that the time which is needed for evacuation to a pressure of about 1 mbar during the conditions mentioned above is about 15 hours, whereas the production time for a refrigerator is about 20 minutes. The evacuation time cannot be improved by using a pump with a higher capacity, since the evacuation time is determined by the narrow communication passages which are present in the powder or cellular material. Of course, there also is a risk that, during the life time of a refrigerator, which is 15–20 years, there will be a leakage through the diffusion-tight layer which means that the contribution which the vacuum gives to the insulation characteristics disappears.

It is also previously known, see U.S. Pat. No. 4,448,041, to use vacuum insulated wall elements for large mobile refrigerating chambers in which the wall elements are connected to a vacuum pump. However, these vacuum pumps are of a conventional type and hence relatively power demanding and expensive. Their use can, with regard to costs and energy consumption, only be suggested for the type of large equipment which is described in the above-mentioned publication.

Further, FR 2628179 describes hermetically sealed wall elements which, in a way which is not described in detail, are connected to some kind of vacuum source. The pressure which is created, 50–100 mbar, is rather high and within such an interval that it can not in any significant way contribute to increase the heat insulating characteristics.

SUMMARY OF THE INVENTION

The purpose of this invention is to achieve an arrangement by means of which it is possible to create a high-quality vacuum insulation for refrigerators and freezers, but where the arrangement does not have the disadvantages which have been mentioned above with respect to the vacuum panels described. The invention is based on the idea that the cabinet, when it is manufactured, is equipped with a small, inexpensive and energy saving vacuum pump having a limited capacity and communicating with hermetically sealed spaces in the walls and the door of the cabinet. Such a pump is shown in U.S. patent application Ser. No. 08/115,479 filed on Sep. 1, 1993. These spaces are filled with heat insulating material also serving as stiffening elements in order to achieve mechanical stability. U.S. patent application Ser. No. 08/115,213, filed on even date herewith, shows a related structure. The energy consumption of the vacuum pump is thus far less than the saving of energy which is a result of the evacuation. When the cabinet is started up by the user, the pump is activated and the pump then gradually creates a very low pressure during a long period of use, which means from a week up to some months, thereby gradually increasing the efficiency of the insulation. This is achieved by means of a device which has the characteristics mentioned below and in the claims.

BRIEF DESCRIPTION OF THE DRAWINGS

One embodiment of the invention will now be described in detail with reference to the accompanying drawing in which the figure schematically shows a section through a refrigerator or a freezer according to the invention.

DETAILED DESCRIPTION OF THE PREFERRED EMBODIMENTS

In the figure, several wall parts 10 or walls defining doors are shown surrounding a cold chamber 11. The wall parts 10 comprise an outer and an inner shell, 12 and 13 respectively, which are connected to each other and which form a hermetically sealed space 14 there between which is filled with heat insulating material. Preferably, all of the walls of the cabinet form one single hermetically sealed space, whereas the door or the doors form separate spaces. The spaces can also be created in other ways, for instance, by surrounding the insulating fill material with a plastic layer which is placed in the shell. The fill material preferably comprises closed cells which are produced by foaming polyol/isocyanate with a gas having such characteristics that it can diffuse through the cell structure with a velocity which is at least five times the velocity of air gasses. A suitable drive gas is carbon dioxide. The space 14 as well as the corresponding spaces in the doors of the cabinet, is, via evacuating channels 15, 16, in communication with an evacuation conduit 17 which is connected to a vacuum pump 18.

The vacuum pump, which has a low capacity, is driven by an electric motor having a power consumption which is less than 5 W and preferably less than 2 W. The evacuation is, according to what is said above, continued for a long time which means that a pressure which is less than 0.1 mbar is upheld in the evacuation conduit 17 and in the insulating material. This level is reached after at least one week of continuous running of the vacuum pump 18. This means that the heat transmission coefficient is reduced by 50% compared to traditional refrigerators which, despite the running of the vacuum pump, results in a considerable saving of energy. The pressure in the evacuation conduit 17 is directly or indirectly sensed by means of a sensor 19 which is connected to an electric control system 20 which deactivates the pump 18 when a specific underatmospheric pressure has been reached in the evacuation conduit. The control means 20 can also be used for activating or deactivating a compressor 21 in the cabinet with a thermostat.

It should be observed that it is possible, within the frame of the invention, to keep the vacuum pump running continuously. It is also possible to disconnect the pump after a first period with a relatively long running time when a sufficient underatmospheric pressure has been reached and to again connect it when the compressor is activated or to activate the pump with respect to the frequency of the connection of the compressor. The connection of the vacuum pump can also be controlled by measuring the time difference for a temperature gradient penetrating the walls of the cabinet. It is also possible to connect the vacuum pump to the compressor so that it can serve as a driving source for the pump.

Although the preferred embodiments of this invention have been shown and described, it should be understood that various modifications and rearrangements of the parts may be resorted to without departing from the scope of the invention as disclosed and claimed herein.

What is claimed is:

1. Electric refrigerator or freezer cabinet comprising a wall which defines at least one hermetically sealed heat insulated space (14), said space containing a heat insulating material which mechanically stiffens the wall and communicating with a vacuum creating device (18) via an evacuation conduit (17), the vacuum creating device being a permanently installed unit in the cabinet which is activated when the cabinet has been installed for use and, after a long period of running, creates a suitable underatmospheric pressure in the space (14).

2. Refrigerator or freezer according to claim 1 wherein the vacuum creating device (18) is a low power consumption pump, the drive motor of the pump having a power consumption which is less than 5 W.

3. Refrigerator and freezer according to claim 1 wherein the vacuum creating device has such characteristics that a pressure less than 0.1 mbar is achieved in the space (14) after more than one week of continuous running of the vacuum creating device (18).

4. Refrigerator and freezer according to claim 1 wherein the vacuum creating device (18) communicates with a pressure sensor which controls the device when a predetermined pressure has been reached in said space (14).

5. Refrigerator or freezer according to claim 1 further comprising at least one compressor (21), the vacuum creating device (18) being activated at the same time the compressor is activated.

6. Refrigerator or freezer according to claim 1, wherein connection of the vacuum creating device is controlled by measuring a time difference for a temperature gradient to penetrate the wall of the cabinet.

7. Refrigerator or freezer according to claim 1 wherein the cabinet wall comprises inner and outer shells which cooperate to form said hermetically sealed heat insulated space and each door forms another hermetically sealed heat insulated space.

8. Refrigerator or freezer according to claim 5 wherein the compressor is used as a drive source for the vacuum creating device.

9. Refrigerator or freezer according to claim 1 further comprising at least one compressor (21), the vacuum creating device (18) being activated as a function of a connection frequency of the compressor.

* * * * *

US005361598B1

REEXAMINATION CERTIFICATE (3726th)

United States Patent [19] [11] B1 5,361,598

Roseen [45] Certificate Issued Feb. 9, 1999

[54] REFRIGERATOR OR FREEZER WALLS

[75] Inventor: Rutger A. Roseen, Lidingö, Sweden

[73] Assignee: Electrolux Research & Innovation Aktiebolag, Stockholm, Sweden

Reexamination Request:
No. 90/004,660, Jun. 6, 1997

Reexamination Certificate for:

| | |
|---|---|
| Patent No.: | **5,361,598** |
| Issued: | **Nov. 8, 1994** |
| Appl. No.: | **115,895** |
| Filed: | **Aug. 31, 1993** |

[30] Foreign Application Priority Data

Sep. 10, 1992 [SE] Sweden ..... 9202607

[51] Int. Cl.[6] ..... F25B 1/00

[52] U.S. Cl. ..... 62/229; 165/96

[58] Field of Search ..... 62/229; 165/96 HV

[56] References Cited

U.S. PATENT DOCUMENTS

| | | |
|---|---|---|
| 1,518,668 | 12/1924 | Mitchell . |
| 1,550,961 | 8/1925 | Hawkins . |
| 1,898,977 | 2/1933 | Comstock . |
| 2,550,040 | 4/1951 | Clar . |

FOREIGN PATENT DOCUMENTS

| | | |
|---|---|---|
| 2628179 | 9/1989 | France . |
| 714174 | 9/1954 | United Kingdom . |
| 865391 | 4/1961 | United Kingdom . |

OTHER PUBLICATIONS

EP Specification — Appl. No. 93 85 0167.3, published 16 Mar. 1994, five pages.

EP Search Report for Appl No. EP 93 85 0167, one page.

*Primary Examiner*—William E. Tapolcai

[57] ABSTRACT

This invention relates to an electric refrigerator or freezer. The cabinet comprises one or several hermetically sealed heat insulated spaces (14) which are wall or door panels of the cabinet. The space or spaces communicate with a vacuum creating device (18) via an evacuation conduit (17). A vacuum creating device is a permanently installed unit in the cabinet, which is arranged to be activated when or after the cabinet has been installed by the user of the cabinet. After a long period of running the vacuum device creates a suitable underatmospheric pressure in the space or spaces (14).

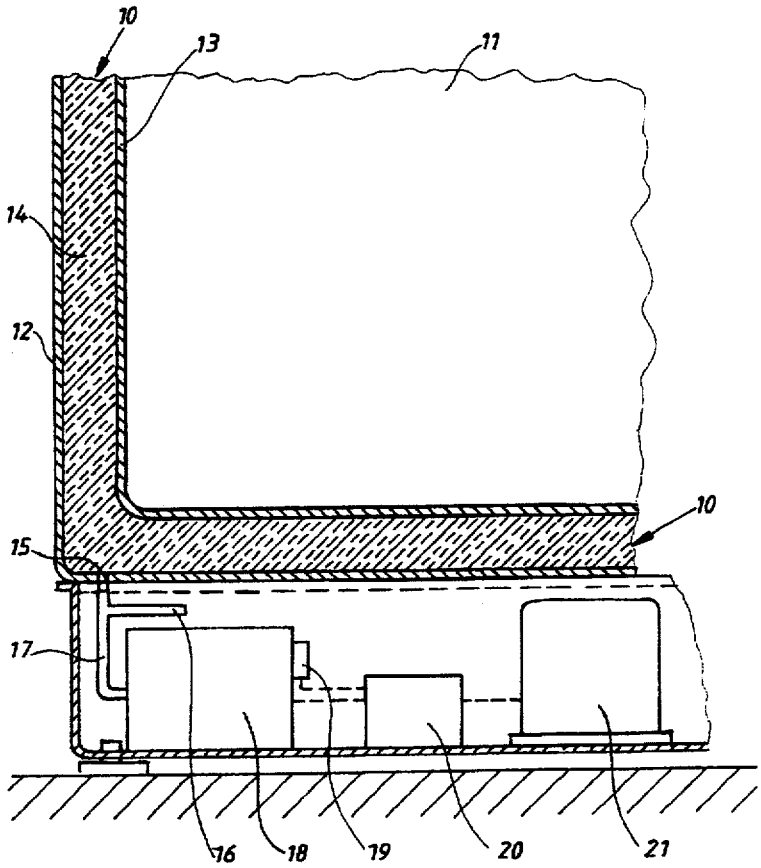

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claim 1 is determined to be patentable as amended.

Claims 3–9, dependent on an amended claim, are determined to be patentable.

1. Electric refrigerator or freezer cabinet comprising a wall which defines at least one hermetically sealed heat insulating space (14), said space containing a heat insulating material which mechanically stiffens the wall and communicating with a vacuum creating device (18) via an evacuation conduit (17), the vacuum creating device being a permanently installed unit in the cabinet which is activated when the cabinet has been installed for use and, after a long period of running, creates a suitable underatmospheric pressure in the space (14), *wherein the vacuum creating device (18) is a vacuum pump, said vacuum pump is a low power consumption pump and is driven by an electric motor, and the electric motor has a power consumption which is less than 5W.*

* * * * *